US008882111B2

(12) United States Patent
Shoemaker, Jr.

(10) Patent No.: US 8,882,111 B2
(45) Date of Patent: Nov. 11, 2014

(54) BULK AMUSEMENT GAME TICKET DISTRIBUTION SYSTEM

(76) Inventor: Stephen P. Shoemaker, Jr., Redondo Beach, CA (US)

( * ) Notice: Subject to any disclaimer, the term of this patent is extended or adjusted under 35 U.S.C. 154(b) by 199 days.

(21) Appl. No.: 13/545,155

(22) Filed: Jul. 10, 2012

(65) Prior Publication Data

US 2014/0015199 A1 Jan. 16, 2014

(51) Int. Cl.
*A63B 67/00* (2006.01)

(52) U.S. Cl.
USPC ..... 273/447

(58) Field of Classification Search
CPC ..... G07F 5/20; G07F 5/26; G07F 5/10; G07F 5/02
USPC ..... 273/447
See application file for complete search history.

(56) References Cited

U.S. PATENT DOCUMENTS

| | | | | |
|---|---|---|---|---|
| 4,582,324 | A * | 4/1986 | Koza et al. | 463/16 |
| 4,598,378 | A * | 7/1986 | Giacomo | 700/236 |
| 5,024,350 | A * | 6/1991 | Shoemaker, Jr. | 221/75 |
| D367,294 | S * | 2/1996 | Shoemaker | D21/312 |
| 5,553,865 | A * | 9/1996 | Shoemaker et al. | 273/448 |
| 5,564,547 | A * | 10/1996 | Ranon et al. | 194/216 |
| 5,775,537 | A * | 7/1998 | Doyle, Jr. | 221/85 |
| 5,967,892 | A * | 10/1999 | Shoemaker, Jr. | 463/7 |
| 6,135,335 | A * | 10/2000 | Shoemaker, Jr. | 226/39 |
| 6,161,743 | A * | 12/2000 | Shoemaker, Jr. | 226/183 |
| 6,234,487 | B1 | 5/2001 | Shoemaker, Jr. | |
| 6,315,157 | B1 * | 11/2001 | Halliburton | 221/87 |
| 6,598,881 | B1 * | 7/2003 | Shoemaker, Jr. | 273/447 |
| 6,626,096 | B1 | 9/2003 | Shoemaker, Jr. | |
| 6,695,698 | B1 * | 2/2004 | Anghelo et al. | 463/25 |
| 6,732,926 | B2 | 5/2004 | Shoemaker, Jr. | |
| 6,770,001 | B1 | 8/2004 | Shoemaker, Jr. | |
| 6,796,487 | B2 | 9/2004 | Shoemaker, Jr. | |
| 6,991,230 | B1 * | 1/2006 | Shoemaker | 273/108 |
| 7,168,702 | B1 | 1/2007 | Shoemaker | |
| 7,192,342 | B2 | 3/2007 | Shoemaker, Jr. | |
| 7,559,552 | B2 | 7/2009 | Shoemaker, Jr. | |
| 7,857,316 | B2 | 12/2010 | Shoemaker, Jr. | |
| 7,857,318 | B1 * | 12/2010 | Shoemaker, Jr. | 273/448 |
| 8,070,167 | B1 * | 12/2011 | Shoemaker, Jr. | 273/447 |
| 8,079,596 | B1 * | 12/2011 | Shoemaker, Jr. | 273/447 |
| 8,079,597 | B1 * | 12/2011 | Wei | 273/451 |
| 8,386,074 | B2 * | 2/2013 | Smith et al. | 700/236 |
| 8,448,948 | B1 * | 5/2013 | Shoemaker, Jr. | 273/447 |
| 8,561,994 | B1 * | 10/2013 | Jeong et al. | 273/451 |
| 8,657,663 | B2 * | 2/2014 | Ajiro et al. | 463/20 |
| 8,721,424 | B2 * | 5/2014 | Ajiro et al. | 463/20 |

* cited by examiner

*Primary Examiner* — Kurt Fernstrom
*Assistant Examiner* — Dolores Collins
(74) *Attorney, Agent, or Firm* — Fulwider Patton LLP

(57) ABSTRACT

The present invention is a prize distribution system for an amusement game that can deliver to a player a brick of tickets in bulk form, or deliver a prize that is shaped like a brick, in a reliable manner that is theft resistant and requires no human interaction to participate. The invention uses a conveyor belt and motor to extract a prize from a stacked or secured configuration, and move the prize to a bin accessible to the player. In a preferred embodiment, the system includes a second motor and door system that opens and closes access to the bin, preventing a would-be thief from reaching through the bin to the prize stack in an attempt to remove a prize.

9 Claims, 5 Drawing Sheets

BULK AMUSEMENT GAME TICKET DISTRIBUTION SYSTEM

BACKGROUND

The present invention is generally related to amusement games such as arcade type games, and more particularly to a prize distribution system for such games that can deliver to a player a large number of tickets or a prize in a safe and reliable manner.

Amusement games of chance and skill are well known in the art. The present inventor has a plethora of patents on such games, such as U.S. Pat. Nos. 8,079,596, 8,070,167, 7,857,318, 7,857,316, 7,559,552, 7,192,342, 7,168,702, 6,991,230, 6,796,487, 6,770,001, 6,732,926, 6,626,096, 6,234,487, 6,161,743, 6,135,335, 5,967,892, and many others. The contents of these patents are incorporated fully herein by reference.

A great many of these games and many other arcade games work on a reward principle, where the players pay for the opportunity to win prizes, either by winning redemption tickets that can be converted into prizes, or by winning the prizes themselves. As competition for the player's attention and money have increased, the need for higher end prizes has continued to grow in the business. Games now feature prizes such as MP3 players, cameras, radios, cellular telephones, and the like. However, to protect the security of such games and prevent theft, these prizes must typically be kept behind a locked counter, where a clerk has access and can distribute the prize once verification has been established. Alternatively, certain games can feature a "Mega" reward that can include thousands of redemption tickets that can be used to trade for a high end prize such as those described above. The problem is that these games are not well equipped to distribute a thousand or more tickets in a convenient manner, and thus either require a clerk be available to distribute the tickets or the player must wait for the game to vend a thousand tickets in small units. This is a drawback of the games currently in arcades and the like that the present invention is intended to remedy.

SUMMARY OF THE INVENTION

The present invention is an amusement game that can deliver to a player a brick of tickets in bulk form, or deliver a prize that is shaped like a brick, in a reliable manner that is theft resistant and requires no human interaction to participate. The invention lies in a prize distribution system that uses a conveyor belt and motor to extract a prize from a stacked or secured configuration, and move the prize to a bin accessible to the player. The prize may be a brick of a thousand tickets that can be won by the player, or it can be any of a type of high end prize such as a phone, radio, MP3 player or the like. In a preferred embodiment, the system includes a second motor and door system that opens and closes access to the bin, preventing a would-be thief from reaching through the bin to the prize stack in an attempt to remove a prize.

BRIEF DESCRIPTION OF THE DRAWINGS

FIG. 6 is an elevated perspective view of a prize comprising an electronic device such as a game controller, MP3 player, radio, cellular phone, and the like.

DETAILED DESCRIPTION OF THE PREFERRED EMBODIMENTS

Figure 1:
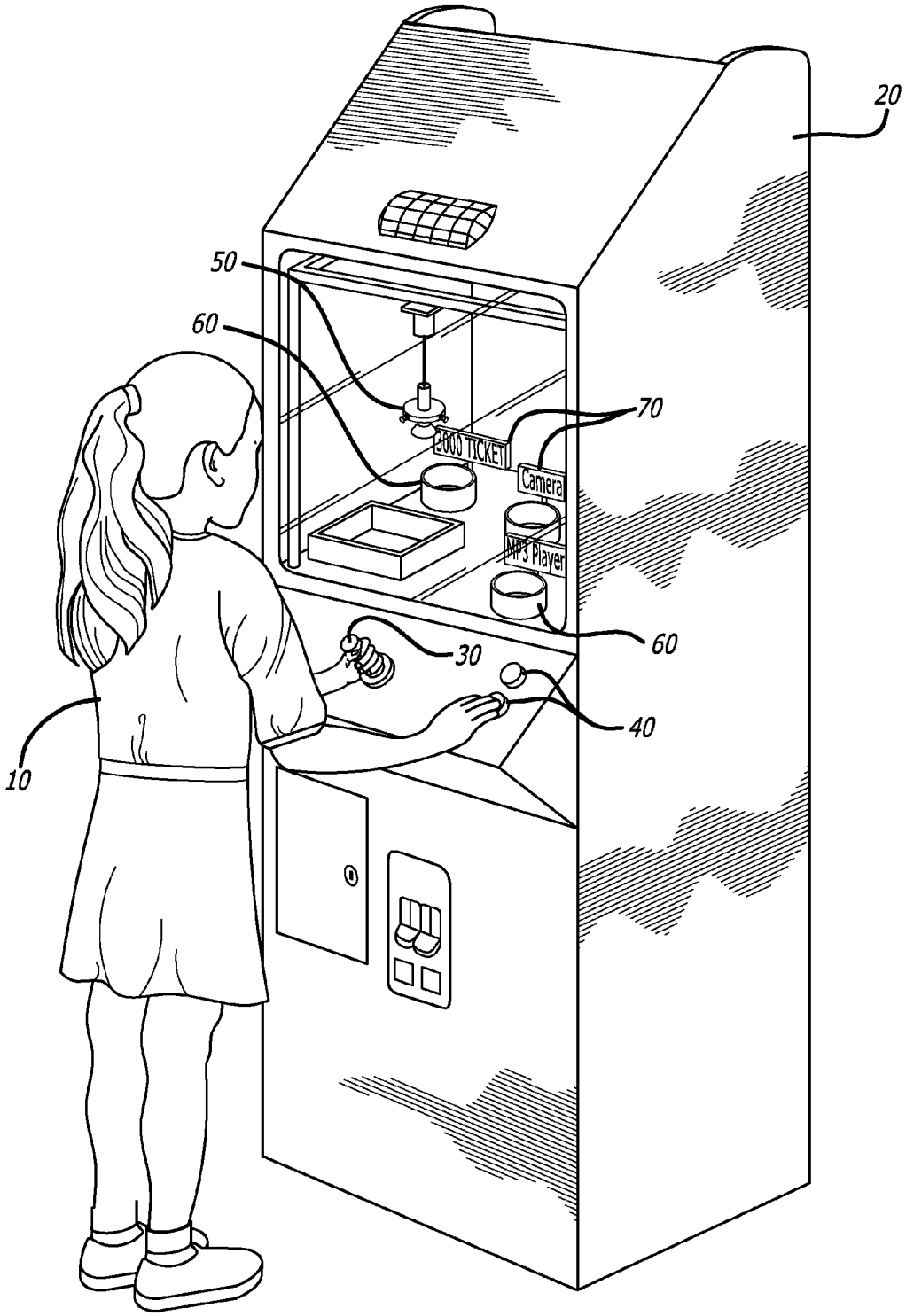
FIG. 1 is an elevated, perspective view of a type of game that can be used with the system of the present invention.

FIG. 1 illustrates an arcade game of the type that the present invention is intended for. It should be made clear that the type of game is not critical to the invention, and that the invention can be incorporated into any of a myriad of arcade type games that reward a player with a prize or redemption tickets, and that game of FIG. 1 is merely exemplary to explain the purpose and mechanics of the invention.

In FIG. 1, a player 10 plays arcade game 20 by manipulating a control 30 and buttons 40. In this game, the player attempts to lower a sensor 50 into a target 60, which will result in the player winning a prize. The reward for each target may be displayed on a sign 70 behind the target 60, and may include either tickets or an actual device. Should the player successfully maneuver the controls 30 to place the sensor 50 inside the target 60, the prize is won by the player 10.

Figure 2:
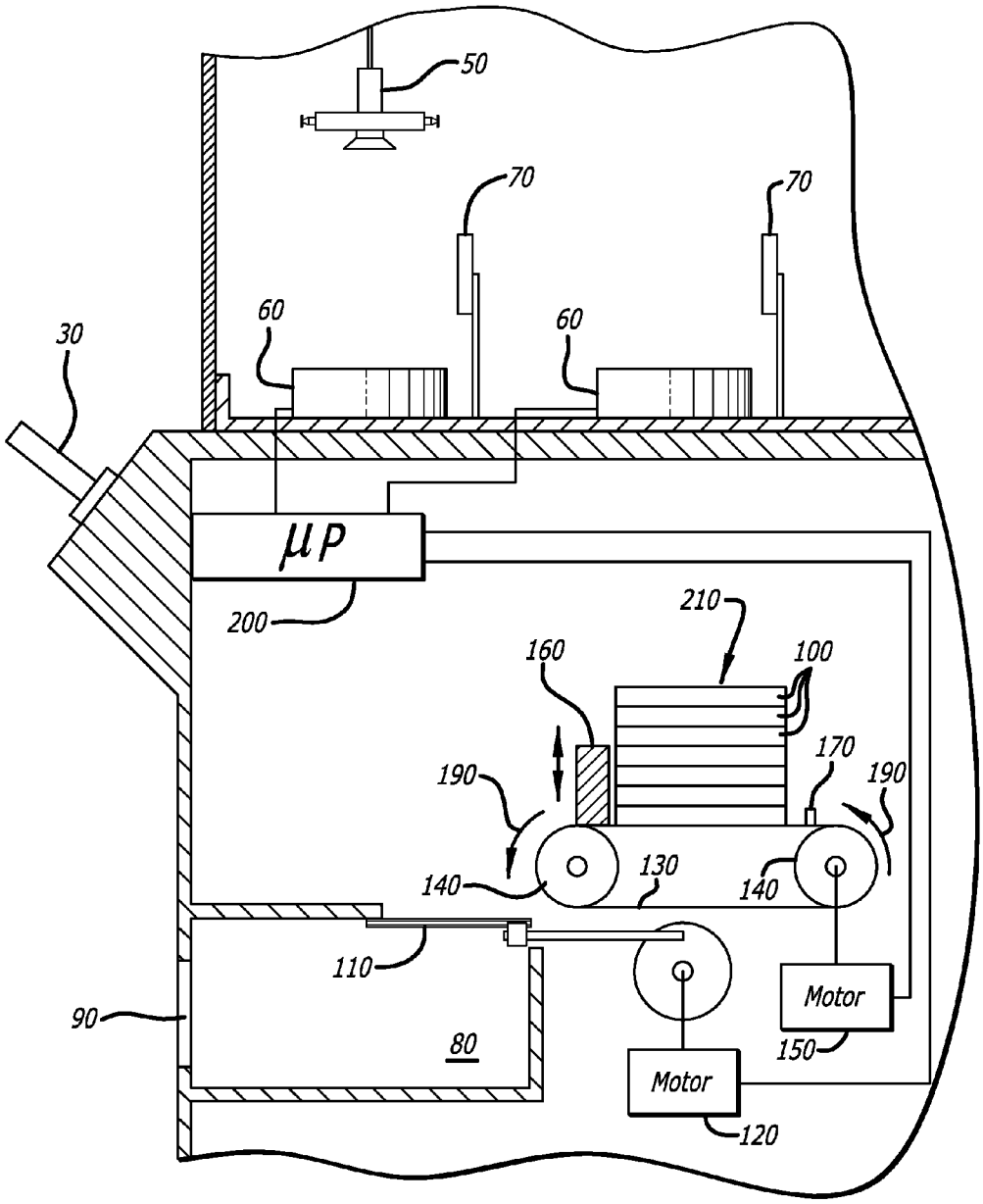
FIG. 2 is a schematic, cross sectional view of the game of FIG. 1 illustrating the components of the system of the present invention.
Figure 5:
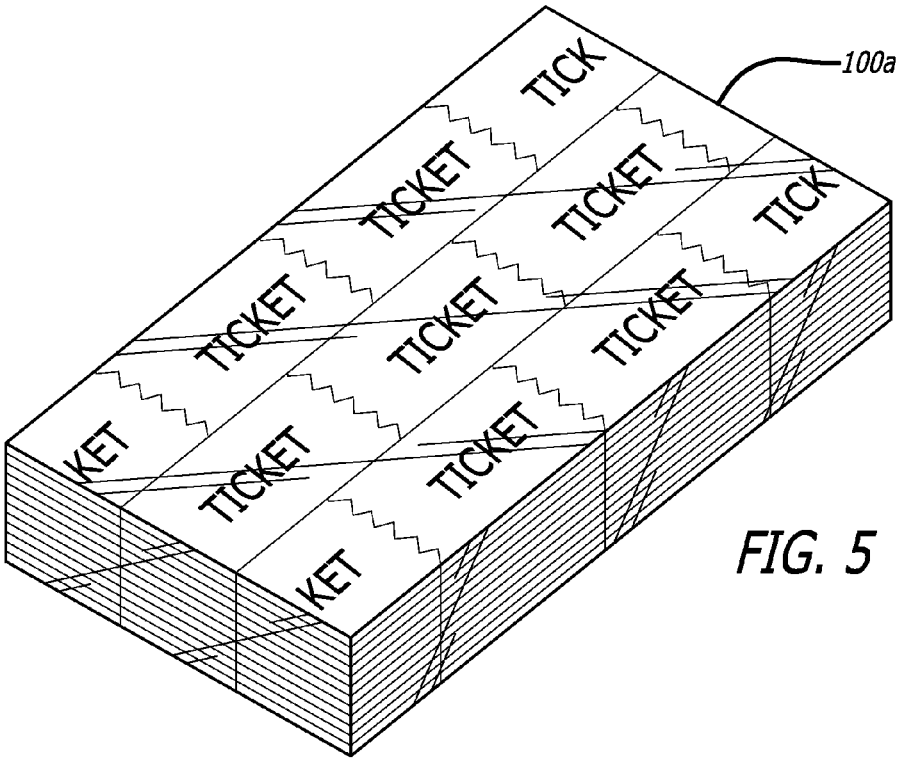
FIG. 5 is an elevated perspective view of a prize comprising a brick of redemption tickets.
Figure 6:
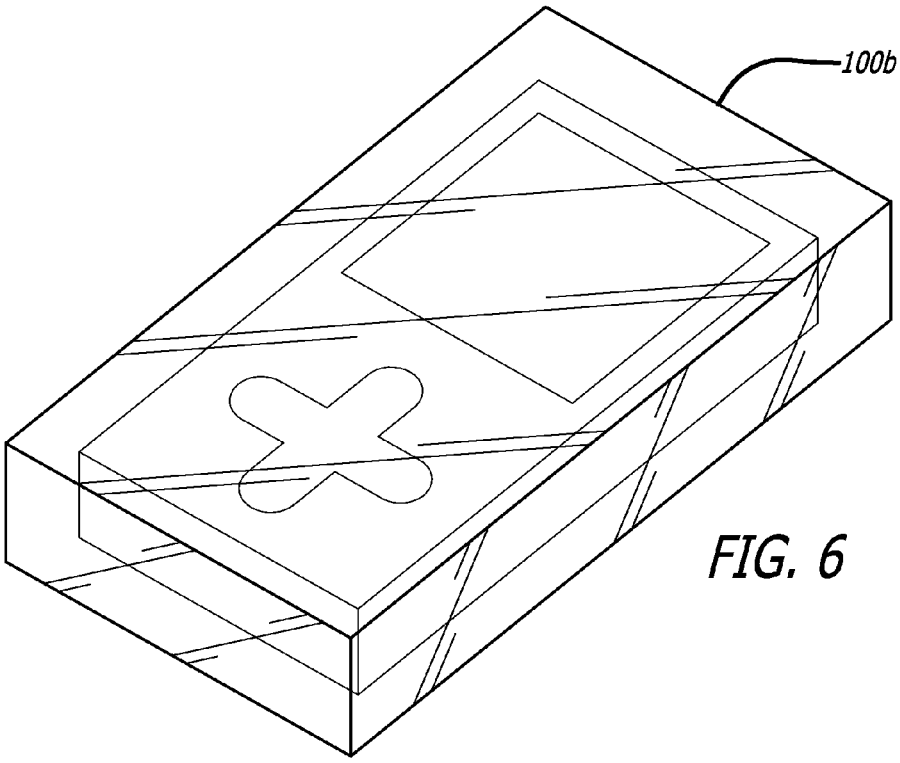

FIG. 2 illustrates the prize distribution system of the present invention as it relates to the game of FIG. 1. If the prize is won, a microprocessor 200 connected to the targets 60 receives a signal from the targets 60 that the player has won a prize 100. The prize 100, which may be a brick of tickets 100*a* (see FIG. 5) or a radio, game controller, phone, or the like 100*b* (see FIG. 6), is located in a stack configuration 210 adjacent to a bin 80 with a player accessible door 90. The bin is closed off from the prize stack 210 by a sliding door 110, which is controlled by a motor 120.

The stack of prizes may rest on a conveyor belt 130 that is positioned on a pair of rollers 140 and actuated by a motor 150 that is controlled by the microprocessor 200. The stack of prizes 210 has positioned adjacent to it a blocker 160 that is lowered against the conveyor belt, but can be raised via a motor or other control (not shown) that is actuated by the microprocessor 200 to an elevation of slightly more than the height of one prize 100, and best seen in FIG. 3. The conveyor belt 130 is also equipped with a pusher 170 that is preferably approximately the height of one prize. With the blocker 160 elevated, exactly one prize can slide below the blocker 160 while moving along the conveyor belt 130, while the remaining prizes 100 in the stack 210 are trapped in place by the blocker 160.

Figure 3:
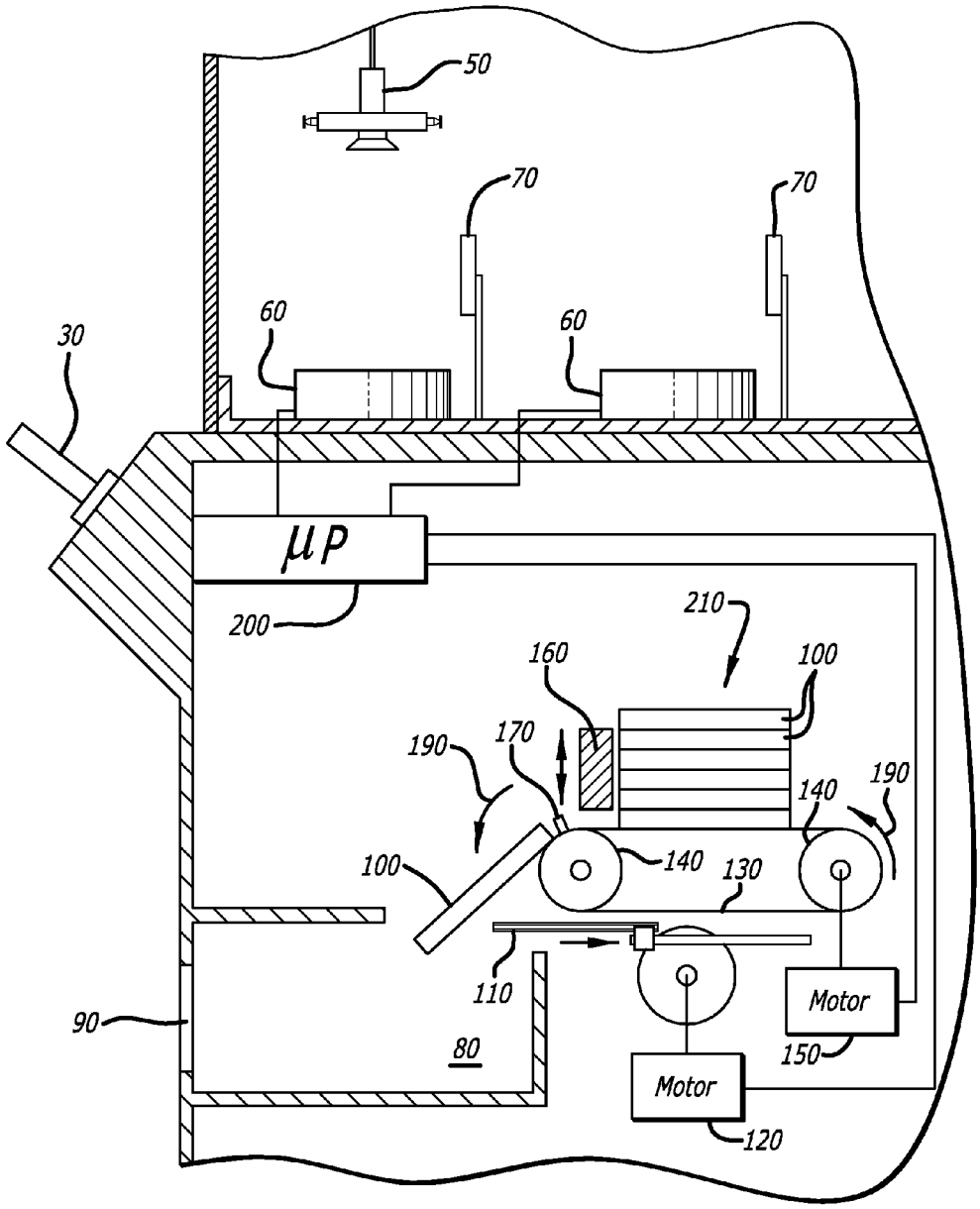
FIG. 3 is a schematic, cross sectional view of the game of FIG. 1 showing how the prize is removed from the prize stack.

In FIG. 3, the microprocessor 200 has first caused the motor 120 to actuate, sliding the door 110 is the rearward direction indicated by arrow 230 to open the bin 80. Once the door 110 is opened, the processor 200 then causes the motor 150 to actuate, turning the conveyor belt in the counterclockwise direction as shown by arrows 190. At the same time, the blocker 160 is raised to allow one prize 100 to pass below, and after the prize 100 passes below the blocker 160 it returns to its original position against the belt 130 to prevent any further prizes from passing beneath. As shown in FIG. 3, this movement of the conveyor belt 130 delivers the prize 100 to the bin 80 as the pusher 170 drives the prize 100 under the blocker 160. The pusher 170 and belt 130 continue to make one full revolution until the pusher 170 returns to its original position. The prize distribution system is now ready to deliver another prize 100.

Figure 4:
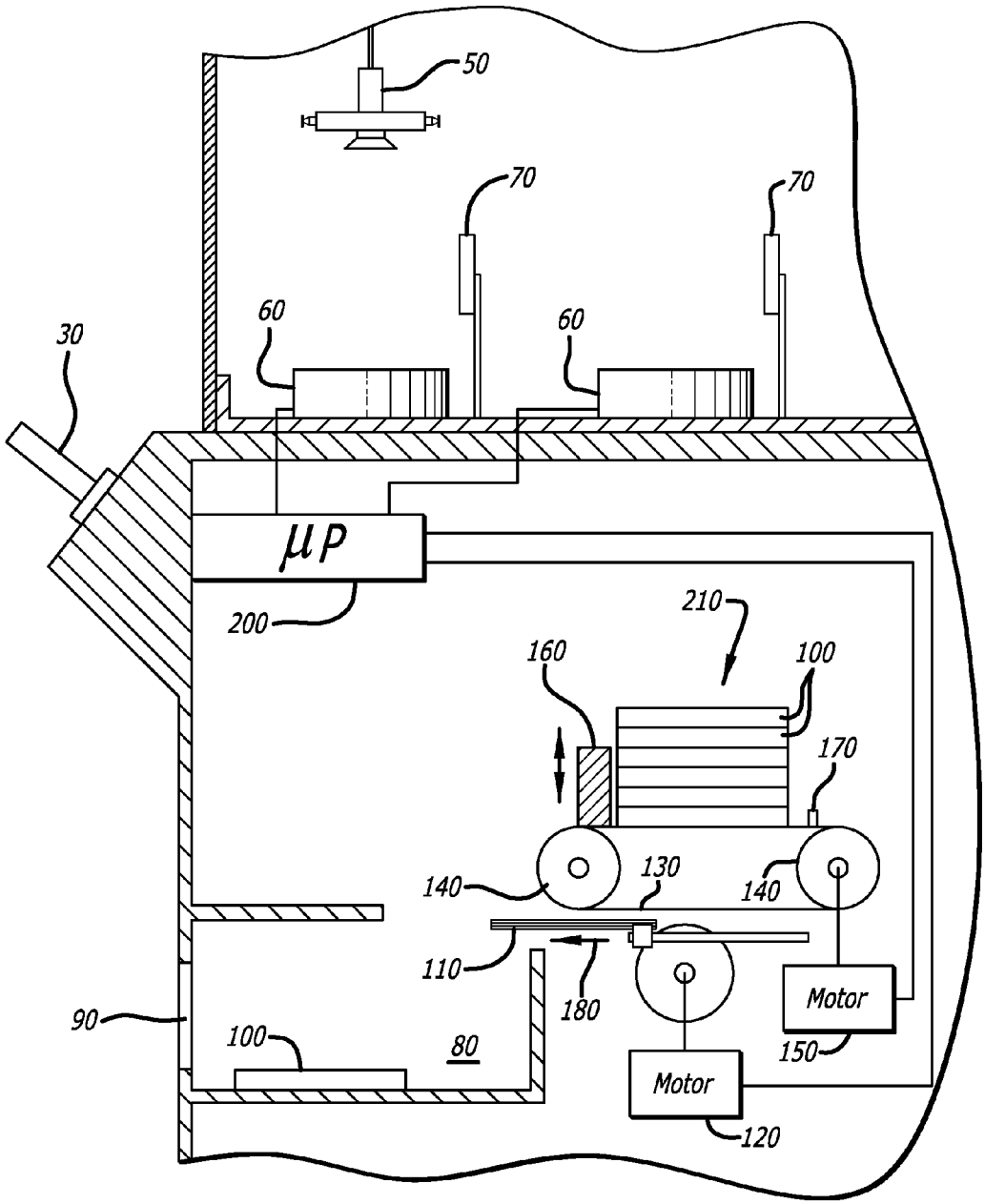
FIG. 4 is a schematic, cross sectional view of the game of FIG. 1 showing the prize entering the bin and a second door closing access to the bin.

Once the prize 100 is delivered to the bin 80, the microprocessor causes the motor 120 to actuate in the reverse direction to close the door 110 as indicated by arrow 180 in FIG. 4, sealing the bin 80 to prevent access to the stack of prizes 210. The player can then access the bin 80 through door 90 and take the prize 100, which may be a brick of tickets 100*a*, a game or electronic device 100*b*, or the like.

The foregoing description of the prize distribution system of the present invention is intended to be merely illustrative and not limiting in the scope of the invention. There are many modifications and alterations that would be readily discernible to one of ordinary skill in the art, and the present invention is intended to encompass all such modifications and alterations. Accordingly, the scope of the present invention should not be limited by anything depicted in the drawings or described herein except where expressly indicated, and the invention should be interpreted in view of the claims below using the terms therein in their ordinary meaning.

I claim:

1. A prize distribution system for an arcade game, comprising:

a microprocessor for determining if a prize has been won by a player;

a conveyor controlled by said microprocessor;

a prize located on the conveyor;

a player accessible bin located below and adjacent the convey;

a bin door that translates from an open position to a closed position, a movement of the bin door controlled by the microprocessor; and wherein the microprocessor causes said conveyor to communicate the prize to the bin after the player has won the prize, and the microprocessor thereafter closing the bin door once the prize is received in the player accessible bin for controlling access thereafter.

2. The prize distribution system of claim 1 wherein the prize is a brick of redemption tickets.

3. The prize distribution system of claim 1 wherein the prize is an electronic device.

4. The prize distribution system of claim 1, wherein the bin door is horizontally driven from a first position below a stack of prizes to a second position over a bin opening.

5. The prize distribution system of claim 1 including a first motor to drive the conveyor and a second motor to drive the bin door.

6. The prize distribution system of claim 1 wherein the prize is located in a vertical stack.

7. The prize distribution system of claim 6, wherein the system includes a blocker for ensuring that only one prize is delivered at a time.

8. The prize distribution system of claim 7 wherein the blocker reciprocates in a vertical direction.

9. The prize distribution system of claim 1 further comprising a pusher connected to the conveyor for pushing a prize into the player accessible bin.

* * * * *